US012379189B2

(12) United States Patent
Morag et al.

(10) Patent No.: US 12,379,189 B2
(45) Date of Patent: Aug. 5, 2025

(54) CAMOUFLAGE EXTERNAL COATING

(71) Applicant: Ametrine Technologies Ltd., En Hahoresh (IL)

(72) Inventors: Elad Morag, En Hahoresh (IL); Uria Kaplan, En Hahoresh (IL)

(73) Assignee: Ametrine Technologies Ltd., Ein HaHoresh (IL)

( * ) Notice: Subject to any disclaimer, the term of this patent is extended or adjusted under 35 U.S.C. 154(b) by 0 days.

(21) Appl. No.: 18/162,743

(22) Filed: Feb. 1, 2023

(65) Prior Publication Data

US 2023/0296355 A1 Sep. 21, 2023

(30) Foreign Application Priority Data

Mar. 20, 2022 (IL) ..... 291529

(51) Int. Cl.
*F41H 3/00* (2006.01)

(52) U.S. Cl.
CPC ..... *F41H 3/00* (2013.01)

(58) Field of Classification Search
None
See application file for complete search history.

(56) References Cited

U.S. PATENT DOCUMENTS

2005/0118402 A1* 6/2005 Henderson ..... F41H 3/00 428/209
2011/0151191 A1* 6/2011 Cincotti ..... F41H 3/02 428/152
2012/0148797 A1* 6/2012 Tsai ..... F41H 3/00 428/137
2013/0137324 A1 5/2013 Tang
2021/0071994 A1* 3/2021 Jacobsson ..... G09F 21/048

FOREIGN PATENT DOCUMENTS

| | | | | |
|---|---|---|---|---|
| CN | 2771797 Y | | 4/2006 | |
| CN | 114179466 A | * | 3/2022 | |
| EP | 2498043 A1 | | 9/2012 | |
| GB | 1605261 A | | 11/1986 | |
| GB | 2360569 A | * | 9/2001 | ..... C23C 16/26 |
| WO | 8801363 A1 | | 2/1988 | |
| WO | WO-8801363 A | * | 2/1988 | ..... F41H 3/00 |
| WO | 2011063249 A1 | | 5/2011 | |

OTHER PUBLICATIONS

CN114179466A Machine Translation via EPO (Year: 2022).*
Notice of Deficiencies for IL Patent Application 291529 dated Jun. 12, 2022.
Sep. 28, 2023—International Search Report—PCT/IL2023/050113.

* cited by examiner

*Primary Examiner* — Laura C Powers
(74) *Attorney, Agent, or Firm* — Banner & Witcoff, Ltd.

(57) ABSTRACT

Camouflage coating systems, apparatuses, and methods described herein may include a coating deposited and bonded to a region of an external surface of an object to be camouflaged. The coating may include a plurality of stacked material arrangements deposited and bonded sequentially onto the region of the external surface and arranged to define a laterally distributed plurality of independent camouflage profiles. The coating may be configured to adjust coating emissivity at visual and IR wavelengths and to block or adjust infrared (IR) emitted by the object, thereby concealing the region of the external surface of the object from detection by a detection method in the visual, infrared, and electromagnetic regimes.

19 Claims, 3 Drawing Sheets

CAMOUFLAGE EXTERNAL COATING

CROSS-REFERENCE TO RELATED APPLICATIONS

This application claims priority to Israeli Patent Application Number 291,529, filed on Mar. 20, 2022, the contents of which are incorporated by reference herein in their entirety.

TECHNOLOGICAL FIELD

Aspects of the present disclosure generally relate to systems, methods, and apparatuses for producing objects with sets of attributes that impart camouflage in the visual, infrared and electromagnetic spectral ranges.

BACKGROUND OF THE INVENTION

Camouflage is used for concealing an object or a person from a variety of detection means during the daytime and/or night hours. Visual as well as thermal and electromagnetic camouflage exploits the use of different colors, materials, textures and/or patterns to conceal an object, rendering it more difficult to be detected or recognized. Most of the technologies available to date concern concealment of objects in two-dimensional (2D) covers. These covers exhibit visibility-related attributes that mimic those of the background that surrounds the camouflaged object, causing the latter to blend with its surrounding background so that it is not detectable by the observer. However, 2D camouflage technologies lack an independent structural support, and as such rely on the object itself to serve as their physical chassis. This is often hard to realize, as the cover has to adjust itself to fit closely the contour map of the camouflaged object.

GENERAL DESCRIPTION

The present disclosure generally relates to spatially adjustable exterior coatings that are configured to adhere to an external surface region of an object, providing it with comprehensive camouflage. The camouflage exterior coatings (CEC) disclosed herein may be constructed of a cohered heterogeneous combination of films and pasted layers, manifesting together a camouflage profile, i.e., a set of attributes that impart the covered object with camouflage in the visual, infrared and electromagnetic regimes.

As will be further detailed herein, the CEC of the present disclosure comprises both functional elements that realize the camouflage related features, and auxiliary layers which provide outdoor operation with extensive durability in extreme weather conditions. It should also be noted that by nature of the fact that the films and layers included in the CEC structure are deposited by painting, spraying, brushing, plastering and/or pasting onto the surface region of the object, it is possible to spatially modulate the features of each film or layer so that its performance is optimized to the part it is designed to cover. In fact, it may be possible to exclude completely a specific film or a layer in a section of the CEC where it may not be needed or modify a thickness of a specific material deposited to fine tune the camouflage properties at a given region of the object's surface. One example of such a layer is the metallic layer, which may not be included in some regions of the object, e.g., a roof of a vehicle, due to the particular thermal and visual features that characterize that region of the object.

Thus, aspects of the present disclosure provide a (multilayered) coating, which is optionally detachable, and which is deposited and bonded or formed directly on a region of an external surface of an object, the coating comprising a plurality of stacked material components or arrangements deposited sequentially onto the region of the external surface and arranged to define a laterally distributed plurality of independent camouflage profiles, wherein the coating is configured for concealing the surface region of the camouflaged object from detection by a detection method in the visual, infrared and electromagnetic regimes, as further defined herein.

The stacked material arrangement is not a composite material. In other words, the layers are not combined under pressure or elevated temperatures to provide the multilayered camouflage cover.

In some embodiments, the plurality of stacked material arrangements comprises laterally distributed features, each of the plurality of stacked material arrangements defining a characteristic camouflage profile.

In some embodiments, at least some (or all) of the plurality of stacked material arrangements are provided as a plurality of segments assembled to provide the coating, wherein each segment has same or different camouflage profile.

Aspects of the present disclosure also provide a coating deposited and bonded or formed directly on a region of an external surface of an object, the coating comprising a plurality of stacked material components deposited sequentially onto the region of the external surface and arranged to define a plurality of independent camouflage profiles configured to conceal a surface region of the object from detection by a detection method operable in visual, infrared and electromagnetic regimes.

As noted herein, in some embodiments, the camouflage profile may relate to a set of camouflage attributes adjusted to the section of the camouflaged object it covers, for its expected scope of operations, and/or weather conditions to which it is subjected.

In some embodiments, the coating may comprise a plurality of spatially distributed stacked material arrangements, each arrangement defining a camouflage profile characteristic of said arrangement.

In some embodiments, the coating may comprise a plurality of segments assembled to provide coating for different sections of the camouflaged object, each segment a defining same or different camouflage profile, and together the segments provide a complete camouflage cover of the object.

Aspects of the disclosure further provide an optionally detachable coating (or layer) covering an external surface region of an object, the coating which is deposited and bonded or formed directly on the object surface is an arrangement of a plurality of stacked material components, said plurality of stacked material components are laterally distributed to define a plurality of camouflage profiles suitable for concealing the external surface region of the object from detection by a detection method.

Further provided is a multispectral coating (or layer) comprising an assembly of a plurality of coating segments, each of the coating segments comprising a stacked arrangement of a plurality of material components, the arrangement defining a camouflage profile characteristic of the segment, wherein the multispectral coating is laterally assembled on an external surface of an object and is suitable for concealing the object from detection by a detection method.

Aspects of the disclosure also provide a system comprising an object and a multispectral coating (or layer) formed or associated with an external surface region of the object, wherein the coating comprises an assembly of a plurality of coating segments, each of said segments comprising a stacked arrangement of a plurality of material components, the arrangement defining a camouflage profile characteristic of the segment, wherein the multispectral coating is laterally assembled on an external surface of an object and is suitable for concealing the object from detection by a detection method.

Also provided by certain aspects of the present disclosure is an object having at least one surface region thereof coated with a coating (or a layer) as described herein. The object to be camouflaged may not be a human or an animal. The object may be any 3D object which concealment by a camouflage system of the present disclosure is desired. The 3D object, or object, may be any civilian object or military object, which may be a vehicle or a stationary object. The vehicles may be selected amongst land vehicles, maritime vehicles, railed vehicles and aircrafts. Non-limiting examples include wagons, bicycles, motorcycles, cars, trucks, buses, trains, trams, ships, boats, underwater vehicles, amphibious vehicles, drones, airplanes, helicopters, aerostats and others.

In some embodiments, the coating may comprise a plurality of material components arranged to define a camouflage profile suitable for concealing the surface region of the object from detection by a detection method.

In some embodiments, the coating may comprise a plurality of coating segments, each of the segments comprising an arrangement of a plurality of material components, the arrangement defining a camouflage profile characteristic of the segment, wherein the coating is suitable for concealing the object from detection by a detection method.

The methodology disclosed herein may be especially adaptable to provide a comprehensive multispectral camouflage. As used herein, the term "multispectral" refers to the ability of the camouflage systems or covers of the present disclosure in providing object concealment from detection across a broad range of wavelength bands in the electromagnetic spectrum. Such range of wavelengths may include the visual wavelengths (between 380 and 700 nm), short infrared (between 700 nm and 3 μm), thermal infrared (between 3 μm and 8 μm), long infrared (between 8 μm and 15 μm), far infrared (between 15 μm and 1 mm) and microwave (between 1 mm and 1 m). The multispectral capabilities thus allow concealment from detection by visual inspection (such as eyes, magnifying tools, cameras, etc.), image intensifiers, heat-seeking devices, thermal imaging sensors, and radar.

In some embodiments, the camouflage cover is configured to provide concealment in the visual and IR wavelength regimes, which may include blurring of the IR radiation emitted by the camouflaged object so that it is indistinguishable from the IR radiation emitted by the background. In addition, the camouflage cover may endow stealth capabilities to the object so that it is not detectable by radar. The camouflage cover may further be suitable to endow camouflage and stealth properties to any stationary object as well as uniquely to mobile objects and platforms, such as land vehicles, aerial vehicles, drones, and any vessel.

The camouflage coating or cover may comprise a plurality of material components that are typically layered or stacked to provide the coating or cover directly on a surface region of an external surface of the object, e.g., mobile object. While typically the coating may be configured to provide a complete coating on the full external surface of the object, in some configurations, coating may be provided on one or more discrete, spaced-apart regions or on a particular surface of the object that is exposed for detection.

The coating may be generally realized in two configurations, each configuration aims to provide a provision of multispectral camouflage, namely, to conceal the object from being detected by a variety of detection methods such as visible detection, infrared detection, thermal imaging and radar detection. In a first configuration, herein referred to as the "skin configuration", the coating may be deposited directly onto the external surface of the object to be camouflaged. Thus, the object external surface may serve as a physical chassis for the coating. The camouflage system implemented by the coating may be substantially undetachable or unpeelable from the object surface. In a second configuration, referred to herein as the "segmented configuration", the coating may be provided as a collection of segments, each provided on a flexible base sheet or substrate that together may be configured to assemble onto an external surface region of the object. In this segmented configuration, each segment may be structured of a planar or curved flexible base plate or sheet or generally a flexible substrate onto which the coating may be applied. The segments may each have a different camouflage profile tailored to fit the camouflage requirements of a section or region of the camouflaged object for which the segment is designed. The shape and size of the segments may be designed so that once they are attached to their respective section or region in the object to be camouflaged, they may form together a complete continuous camouflage coating or cover. The attachment of the segments to their respective location across the surface of the object may be achievable by an attachment surface provided at the back face of each segment substrate onto which the coating or layer is formed. The attachment surface may generally be selected to permit replaceability of the segments, as well as quick and facile attachment and detachment to or from the object. Such attachment surface may include touch fasteners (such as Velcro) magnets, adhesives and others.

The replaceability of the segments in the segmented configuration, unlike the skin configuration, provides the user with the ability to adjust the camouflage profile of the coating formed to fit different operation landscapes and environmental conditions. It may also enable replacing segments that were damaged.

In both configurations, a desired camouflage profile may be achieved by proper positioning or structuring of various material components in the coating. The selection of the material components combined with their structuring (position, distribution, etc.) within the coating realize a camouflage profile that may be regionally adjusted to fit discrete or preselected regions of the object to be camouflaged or to certain segments of the segmented structure. As used herein, the "camouflage profile" refers to a comprehensive camouflage signature or a selection or a set of camouflage attributes emerging from a particular selection of material components combined with their structuring within the coating. For example, a plurality of material components may be selected and arranged to define a camouflage profile suitable for protecting a surface region of the object against detection by infrared detection. Such an arrangement may entail, for example, the inclusion or exclusion of a material component that otherwise would not be included (or may be included) for a camouflage profile suitable for protecting against radar detection. The camouflage attributes include emissivity at visual and IR wavelengths, IR blocking (full or partial blocking) for adjusting the IR emitted by the camouflaged object, a predefined ratio between scattering and specular reflection of light incident on the external surface of the camouflage object and stealth related attributes which comprise adjusting the absorption of radar beams incident on the object and diverting it from being reflected back towards its source.

For both the skin and segmented configurations, the coating comprises a layered assembly of material components which may include one or more of the following:

an interface layer,
an insulation layer,
a hardening layer,
an infrared (IR) blocking layer,
a visual and/or IR emissivity layer,
an anticorrosion layer; and
a water repelling layer.

The interface layer may be applied directly on the surface of the object to be camouflaged or on a base material or substrate, typically a flexible substrate, which may be made from a material selected from metallic materials or compositions thereof, e.g., metal sheets; fabric materials; fabric or polymeric or metal nets; and other base materials that may be provided as sheets, films, nets, etc.

The interface layer, separating between either the surface of the object and the functional layers of the coating in the skin configuration, or a base layer of the segment and the coating in the segmented configuration, may be configured as an adhesive layer enabling attachment of the functional layers to the object surface or segment surface, and/or as a filler layer that serves to cover dents or deformities on the object surface or segment surface. The layer may typically be composed of a resin mixed with various filler materials, and may include one or more of the interface materials listed in Table 1 below.

TABLE 1

Exemplary materials for the interface layer according to some aspects of the disclosure.

| No. | Name of Interface Materials |
|---|---|
| 1 | Nano Z ESP700 |
| 2 | Nano Z NMF-02 |
| 3 | NTSI Hydroseal |
| 4 | NTSI Nanoseal |
| 5 | Sika AG 850 |
| 6 | Sika LAM |
| 7 | Sika 925T |
| 8 | CarPro CQUARTZ SiC |
| 9 | CarPro CQUARTZ BlackOut |
| 10 | CarPro HydrO2 |
| 11 | SPI Enamo Grip |
| 12 | SPI Super Therm |

The insulation layer may be selected or designed to prevent heat generated by the object from flowing by conduction and convection towards an external surface of the coating, thereby preventing the external layers of the coating from being heated, becoming themselves a source of IR radiation. The thickness of the insulation layer may be designed according to the heat source it covers (typically 3-50 mm). In other words, the hotter or the more energy the surface to be camouflaged generates, the thicker may be the insulation layer.

The insulation layer may further endow the camouflage assembly with a three-dimensional structure which, in some configurations, may play a role in the thermal and radar camouflage capabilities. In other words, the top surface of the insulation layer, adapted to receive thereon a layer of a hardening material, may be imparted with 3D patterns for diverting radar beams at relevant radio frequencies that are incident on the camouflaged object, from returning back towards their transmission point. This may endow the coating with stealth capabilities as it attenuates the returning radar signal matching it with the signal that returns from the background. In addition, the 3D patterns may be superimposed with random roughness that may serve to scatter the ambient illumination from being specularly reflected. The latter function may enable, in particular, the inhibition of the reflection of ambient light from the sky that is incident on the top part of the camouflaged object.

TABLE 2

Insulation materials according to some aspects of the disclosure.

| No. | Name of Insulation Materials |
|---|---|
| 1 | Tambur 850 |
| 2 | Tambur CS330 |
| 3 | Mascoat Industrial-DTI |
| 4 | Mascoat WeatherBloc-HRC |
| 5 | SPI HSC |
| 6 | SPI HPC |
| 7 | SPI Omega Fire |
| 8 | Sika PIR |
| 9 | Palziv Vizion ™ |
| 10 | Palziv Fuzion ™ |
| 11 | Sika Boom ®-163 |
| 12 | Sika EPS |
| 13 | BOSTIK P605 FOAM'N'FILL FLEX AIRSTOP |
| 14 | Zwaluw PU-Foam 750 |

In some configurations, the insulation layer may be formed of an insulating material that is a porous material. Exemplary materials are listed in Table 2. The 3D patterns may be formed by spraying, brushing, patterning, stamping in a soft insulating layer or by material removal.

The hardening layer, which in some configurations may include a resin layer, may be applied on top of the insulation layer, adopting its contour and hardening upon setting. This layer may be configured to provide mechanical strength to the insulation layer, constituting a second substrate that may support the films and strata that are deposited thereon. In certain configurations, such as the segmented configuration, or in certain implementations of the coating, the hardening layer may be formed on a mediating fabric or a net-fabric that may be placed between the insulation layer and the hardening layer to prevent the disintegration of the insulation layer during attachment of the segments to their respective location on the object.

Non-limiting examples of resins may include an epoxy resin, a polyester resin, a Gelcoat resin (epoxy or polyester with wax), a vinyl ester resin, a phenolic resin and a polyurethane. Non-limiting examples of fabrics that may be used are provided in Table 3 below:

TABLE 3

Exemplary materials for the hardening layer according to some aspects of the disclosure.

| No. | Name of Material |
|---|---|
| 1 | PPG 625 Polythane |
| 2 | PPG PPT |
| 3 | Sherwin William Polane T |
| 4 | Sherwin William Polane B |
| 5 | SPI Enamo Grip |
| 6 | Buxly Polyurethane Enamel |

The IR blocking layer may be a metallic layer made of a colloidal solution of organic or water-based solvents containing a suspension of metallic particles and deposited directly on the insulation layer. The metallic particles may be made of a metal such as copper, silver, aluminum, titanium, nickel, tin, chromium or iron or made of carbon. The metallic layer may be configured to prevent thermal radiation at IR wavelengths emitted by the camouflage object from being detected by an IR detection means such as an IR (thermal) camera.

In some embodiments, the IR blocking layer or component may be configured to prevent thermal radiation at IR wavelengths emitted by the object from being detected by an IR detection means such as an IR (thermal) camera.

In some embodiments, the IR blocking layer or component may be configured to at least partially block an object IR radiation in a spectral bandwidth ranging between short infrared (between 700 nm and 3 μm) to far infrared (between 15 μm and 1 mm).

In some embodiments, the IR spectral bandwidth may be between 3 μm and 8 μm or between 8 μm and 15 μm or between 15 μm and 1 mm.

In some embodiments, IR blocking may be provided by way of a metallic paint or a metallic layer including a colloidal composition of metallic particles, which in some configurations may be made of a metal such as copper, silver, aluminum, titanium, nickel, tin, chromium or iron, or oxides or complexes thereof, or may be made of carbon allotropes such as CNTs and CNT-based materials, graphene and graphene-based materials, etc.

In some embodiments, the metallic paint or metallic layer may be provided by deposition of metallic particles on a fabric/resin layer or directly on an insulation layer or component, in cases the insulation layer is included in the camouflage coating.

Non-limiting examples of the particles suitable for use in constructing the IR blocking layer include those listed in Table 4:

TABLE 4

IR blocking materials used according to some aspects of the disclosure.

| No. | Name of IR Materials |
|---|---|
| 1 | PPG METALLIC TONES |
| 2 | Tambour Silver Poliur |
| 3 | Tambour Metal touch |
| 4 | Rustoleum Metallic Accents |
| 5 | Eastwood Metallic Single Stage Paint |

The visual and IR emissivity layer may be configured to provide a spatially modulated emissivity in the visual and IR wavelength ranges. This layer may comprise a collection of films of different colors that are painted on top of the IR layer and laterally distributed as a collection of pigmented patterns. The combined effect of the patterns may impart the coating with an external emissivity that may mimic both geometrically and spectrally at the visual wavelengths, the typical emissivity of the object background in the theater of operation for which the system is made. This layer may additionally comprise patterns of metallic paint that may be similar to the metallic paint used for the IR blocking layer so that the IR component under ambient illumination may be scattered and reflected similar to its scattering and reflection by the background.

Non-limiting examples of pigment materials which may be used for forming the patterns are provided in Table 5.

TABLE 5

IR and Emissivity materials used according to some aspects of the disclosure.

| No. | Name of Material |
|---|---|
| 1 | Dulux Easycare |
| 2 | PPG SPEEDHIDE Interior Latex |
| 3 | PPG TIMELESS Interior Paint |
| 4 | Sherwin-Williams ® Ultra 7000 ® |
| 5 | Sherwin-Williams ® Acry Glo |
| 6 | Rustoleum Ultra Cover |
| 7 | Rustoleum 3700 System DTM Acrylic Enamel |
| 8 | Tambur Monocoat F.D |
| 9 | Tambur Tamagaurd EN-80 |

The anticorrosion layer may comprise an anticorrosion varnish that is configured or selected to extend the durability of coating materials such as metallic materials for outdoor operation at extreme weather conditions. Non-limiting examples of anticorrosion materials are provided in Table 6.

TABLE 6

Anticorrosion materials according to some aspects of the disclosure.

| No | Name of Material |
|---|---|
| 1 | Sikagard ® Hygienic Coatings |
| 2 | Sikafloor ® Marine Primer |
| 3 | Sikagard ®-6440 S |
| 4 | Sika ® Primer-210 |
| 5 | SPI SP Liquid Membrane |
| 6 | SPI Rust Grip |
| 7 | Tambur SSPC |
| 8 | Tambur HS-810 |

The water repelling layer may be made of a transparent water-repelling paint selected for reducing water absorbance by layers of the camouflage assembly, and for reducing IR reflection and scatter from a wet external surface of the coating due to the high emissivity of water at the relevant IR wavelengths. Non-limiting examples of water repelling materials are provided in Table 7.

TABLE 7

Water repelling materials used according to some aspects of the disclosure.

| No. | Name of Material |
|---|---|
| 1 | Nano Z ESP700 |
| 2 | Nano Z NMF-02 |
| 3 | NTSI Hydroseal |
| 4 | NTSI Nanoseal |
| 5 | Sika AG 850 |
| 6 | Sika LAM |
| 7 | Sika 925T |
| 8 | CarPro CQUARTZ SiC |
| 9 | CarPro CQUARTZ BlackOut |
| 10 | CarPro HydrO2 |
| 11 | SPI Enamo Grip |
| 12 | SPI Super Therm |

Aspects of the present disclosure further provide methods for forming a camouflage coating on a region of an external surface of an object, that include applying onto the region of the external surface of the object a coating comprising a plurality of stacked material components, each of the material components deposited sequentially onto the region of the external surface or on a preceding layer and arranged to define a plurality of independent camouflage profiles, wherein the coating is configured to conceal the surface region of the object from detection by a detection method operable in visual, infrared and electromagnetic regimes.

According to some additional aspects of the disclosure, a method is provided for forming a camouflage coating on a region of an external surface of an object, the method comprising assembling a plurality of discrete segments onto the region of the external surface of the object, wherein each of the discrete segments having a coating comprising a plurality of stacked material components, each deposited sequentially onto the segment; and laterally joining (or conjugating or fixing the segments to each other) to define a continuous coating including a plurality of independent camouflage profiles, wherein the coating is configured to conceal the surface region of the object from detection by a detection method operable in visual, infrared and electromagnetic regimes.

Each two segments may be laterally joined or conjugated together in the assembled camouflage system or camouflage cover, side-by-side, not one on top of the other, such that the segments boundaries may meet to provide the continuous system or cover. The joining may be achievable by any one chemical or physical means, including adhesives, hooks, quick release elements such as Velcro, by using a restructured frame, by use of a net, or by any other means.

In the segmented configuration, coating may be provided on a rigid or semi-rigid base plate or substrate which may act as a physical chassis of the segment. The base plate or substrate may be a metallic substrate, a polymeric substrate, a ceramic substrate, a rigid fabric substrate or any other solid substrate. In some embodiments, the substrate may be a metallic substrate, e.g., made of an aluminum sheet or substrate, or a polymeric substrate such as a partially elastic plastic material.

Each of the material layers constituting together a coating may, according to the present disclosure, be applied or formed by spraying, brushing, painting, printing, pasting, plastering or by any other mode of application directly on the object surface (in case of the skin configuration) or the substrate (in the case of the segmented configuration), or on a layered material previously formed thereon. For example, resinous materials, such as those used for the interface layer and the hardening layer, as well as other functional materials that may be used for forming the IR layer, the anticorrosion layer and the water-repellent layer, may be applied by spraying or brushing. Net-fabrics as well as solid sheets and fabrics that may be used as supporting structures may be pasted or glued onto the substrate or on a previous layer formed. Patterns formed part of the emissivity layer may be painted or sprayed or brushed as may be the case.

The ability to provide a location-dependent camouflage system, wherein the camouflage profile varies laterally over the continuous camouflage system depending on surface features (size and shape of the surface, specific out-of-plane features, etc.) and surface position (proximity to heat generating features in the camouflaged object, position with respect to solar radiation, etc.) on the object, enables tailoring of a plurality of region-specific multispectral properties that may be spatially and continuously arranged, i.e., no spectral barrier may exist between the regions. Regions of different camouflage profiles may be formed in the skin configuration by inclusion or exclusion of specific functional layers and in the segmented configuration by selecting segments having particular predefined spectral properties or camouflage profiles.

Thus, in a multispectral coating (or layer) including a plurality of regions, each of said regions includes a stacked arrangement of a plurality of material components defining a camouflage profile characteristic of the region in the camouflaged system, the coating regions may be regions of a coating in a skin configuration or segments in the segmented configuration.

The coating may be configured for concealing the object from detection by a detection method selected from visible detection, infrared detection and thermal imaging, and radar detection.

Some aspects of the present disclosure provide a thermal camouflage at the infra-red (IR) wavelength range, in particular at the "atmospheric windows" of between 3 μm and 5 μm, and between 7 μm and 14 μm where the atmosphere is mostly transparent, and accordingly concealment from the operative wavelength layers of thermal cameras. The IR emitted by an object (and background) may have two components: (i) the IR generated by the camouflaged object due to its internal temperature; and (ii) the IR component of the ambient illumination that may be reflected and scattered from the surface of the camouflaged object. In a coating of the invention these two components may be handled separately. The coating disclosed herein may contain an internal IR "metallic" film so that the IR generated by the object to be camouflaged may be blocked (or partially blocked as the case may be), and metallic patterns in the colored film of the emissivity layer that cause IR contained in the ambient illumination to be reflected and scattered from the object, so that it mimics the IR that is reflected and scattered from the background.

Aspects of the disclosure also provide a kit for assembling a camouflage coating on an external surface of an object, the kit may include a plurality of segments having a size and a shape enabling lateral assembling on an external surface of the object, each of the plurality of segments having same or different camouflage profiles; and instructions of use. The segments may each be as defined herein.

BRIEF DESCRIPTION OF THE DRAWINGS

In order to better understand the subject matter that is disclosed herein and to exemplify how it may be carried out in practice, embodiments will now be described, by way of non-limiting examples only, with reference to the accompanying drawings, in which.

DETAILED DESCRIPTION

Specific non-limiting configurations of camouflage systems of the present disclosure are depicted in FIGS. 1-5.

Figure 1:
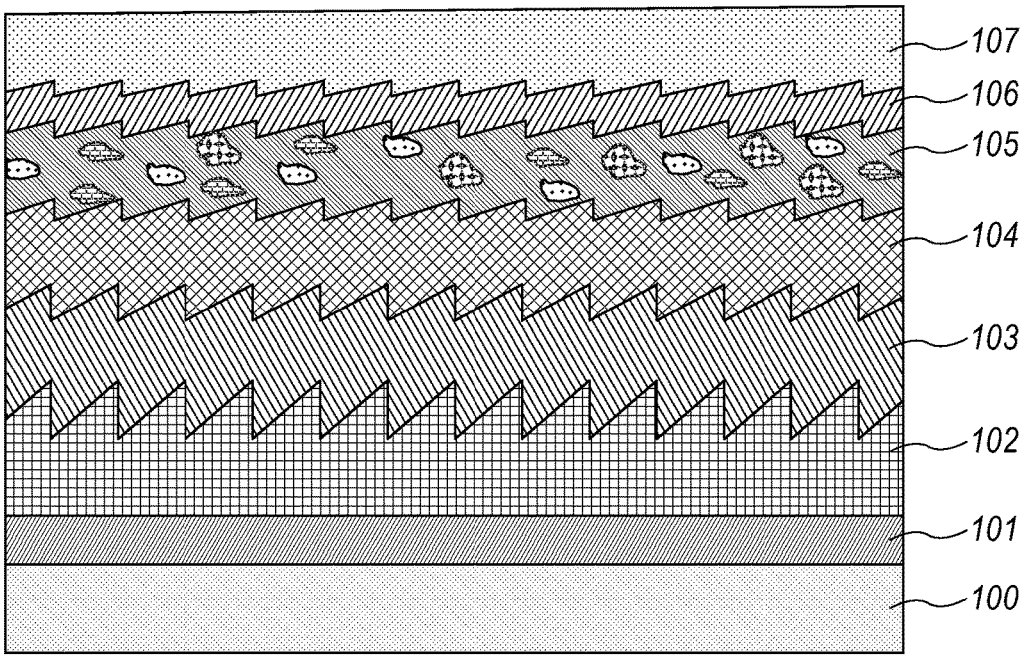
FIG. 1 depicts layered material components according to some embodiments of the present disclosure.

FIG. 1 provides a schematic representation of a layered assembly of material components according to some embodiments of the invention. A segment according to some embodiments disclosed herein is shown in FIG. 2.

Figure 2:
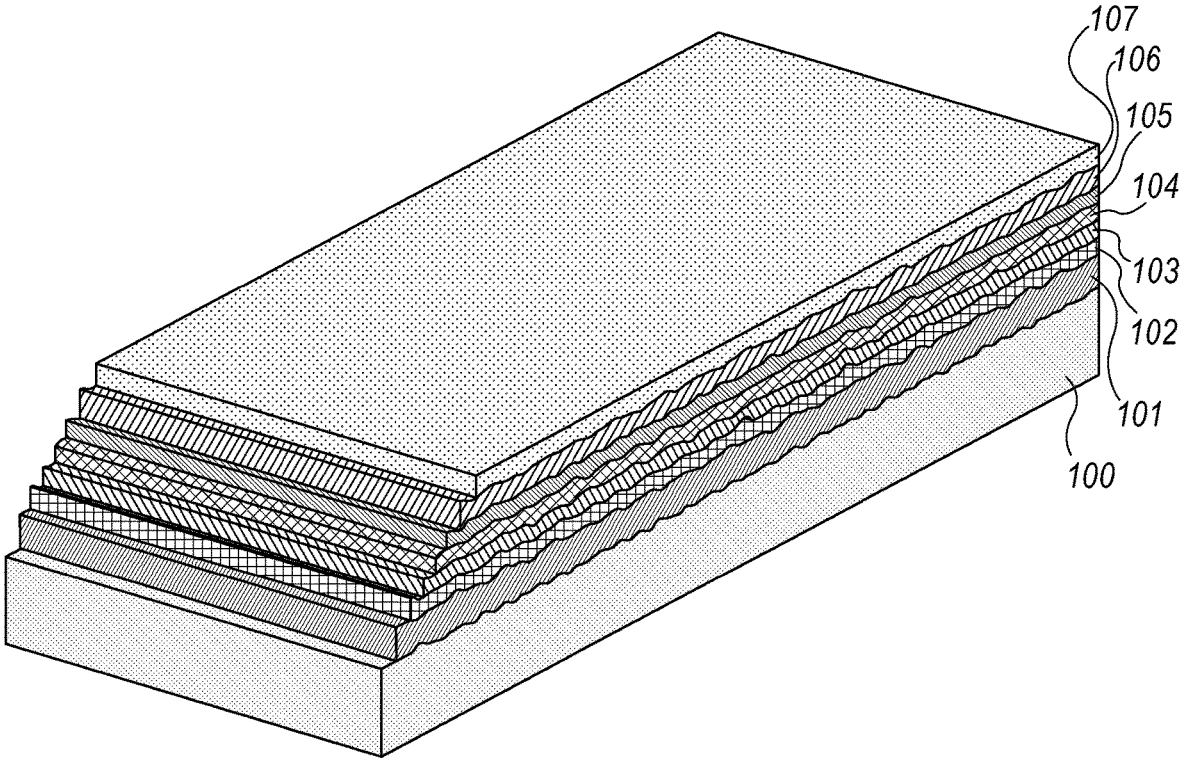
FIG. 2 depicts a side view of a layered material components in a segment according to some embodiments of the present disclosure.
Figure 3:
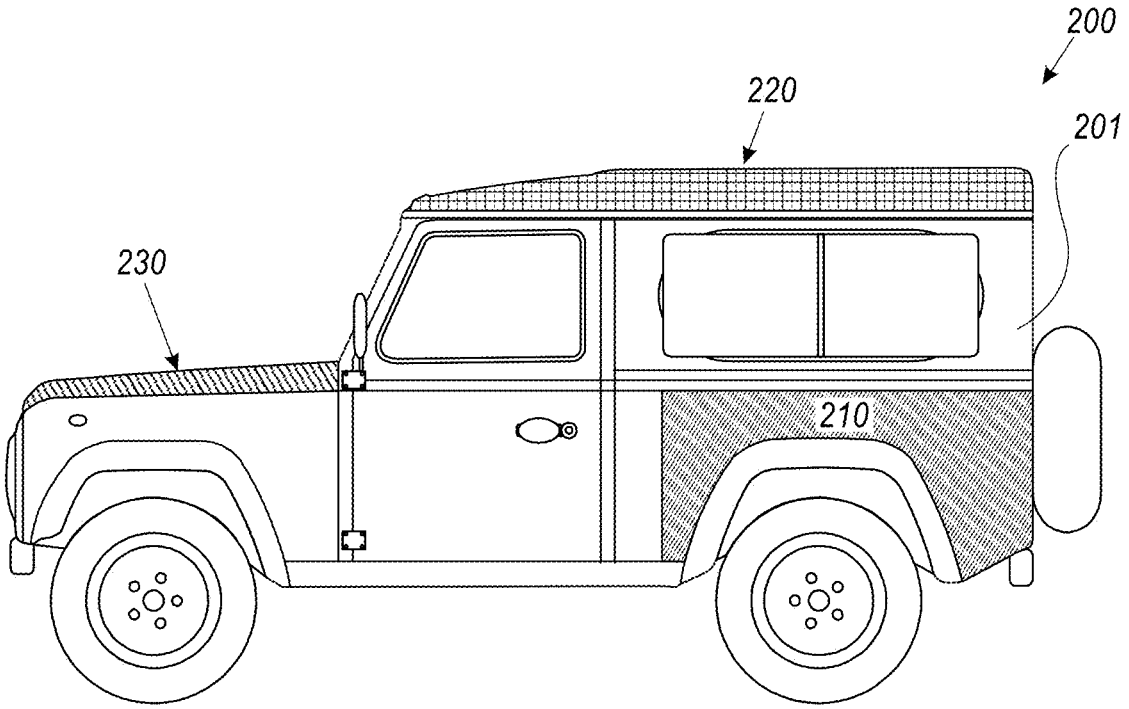
FIG. 3 is an illustration of a vehicle having three distinct regions having different continuous coating of a camouflage according to the present disclosure.

As depicted in FIG. 1 and in FIG. 2, each layer represents a material layer according to some configurations of the present disclosure. In the configurations depicted herein, the camouflage coating is formed on a substrate 100 which may be an object's external surface or a substrate of a segment, as defined herein. Each of the material components may be sequentially formed on the surface or the substrate by a suitable means of deposition or application. In an exemplary sequence, an interface layer 101 is formed on the surface or substrate, followed by application or deposition of an insulation layer 102, a hardening layer 103, an infrared (IR) blocking layer 104, a visual and/or IR emissivity layer 105, an anticorrosion layer 106, and a water repelling layer 107. In other exemplary sequences, the camouflage coating formed on the surface or substrate may include any number of variations or alterations of interface layer 101, insulation layer 102, hardening layer 103, IR blocking layer 104, visual and/or IR emissivity layer 105, anticorrosion layer 106, and water repelling layer 107. For example, various layers may be repeated or omitted without departing from the scope of the present disclosure.

The camouflage coating may be applied on any region of the object, e.g., on any portion of the substrate 100. By selecting the composition of the material components to be applied and the sequence of layers, a plurality of camouflage profiles may be obtained such that each profile corresponds to predetermined camouflage demands based on, e.g., the location of the region to be coated on the external surface of the object. In the illustration provided in FIG. 3, a camouflaged vehicle 200 is shown, which external surface 201 is provided with three continuous yet distinct surface regions 210, 220 and 230 that are covered each with a different set of material components, and/or in a different layering sequence, thereby each exhibiting a different camouflage profile. In this particular example, different profiles are employed in view of the position and the specific characteristics of each surface region, e.g., roof versus side panels and engine cover.

Figure 4:
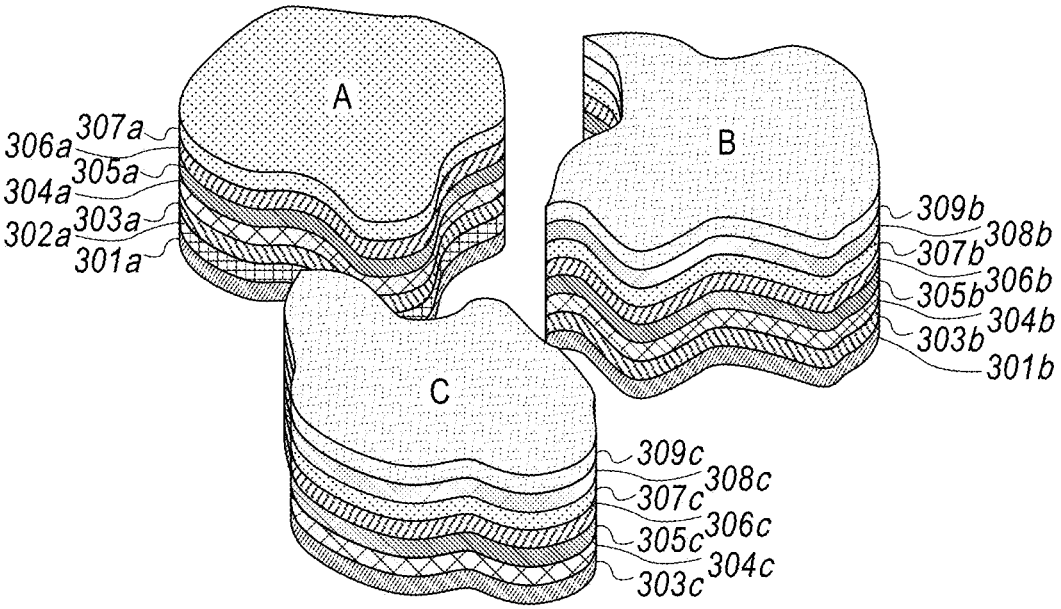
FIG. 4 depicts three segments according to some embodiments of the present disclosure.

A camouflage coating may also be provided by assembling a plurality of segments, as depicted in FIG. 4. In the exemplified illustration, three segments are shown of different shapes and sizes that are provided with different material layers; thus, each segment exhibits a different camouflage profile. Each of layers 301*a* through 309*a*, 301*b* through 309*b*, and 301*c* through 309*c* represents a different selection of material layers including an insulation layer, a hardening layer, an IR blocking layer, a visual and/or IR emissivity layer, an anticorrosion layer, and a water repelling layer. As depicted, segment A may be formed on a substrate 301*a* and may include six layered materials (302*a*, 303*a*, 304*a*, 305*a*, 306*a* and 307*a*) selected from an insulation layer, a hardening layer, an IR blocking layer, a visual and/or IR emissivity layer, an anticorrosion layer, and a water repelling layer. Segment B may be formed on a substrate 301*b* and may include seven layered materials (303*b*, 304*b*, 305*b*, 306*b*, 307*b*, 308*b* and 309*b*) selected from an insulation layer, a hardening layer, an IR blocking layer, a visual and/or IR emissivity layer, an anticorrosion layer, and a water repelling layer. Similarly, segment C formed on be formed on a material layer 303*c*, e.g., a fabric, and include further six additional material layers (304*c*, 305*c*, 306*c*, 307*c*, 308*c* and 309*c*) selected from an insulation layer, a hardening layer, an IR blocking layer, a visual and/or IR emissivity layer, an anticorrosion layer, and a water repelling layer. Still further, various segments may be provided with less than six layered materials or more than seven layered materials without departing from the scope of the present disclosure.

Figure 5:
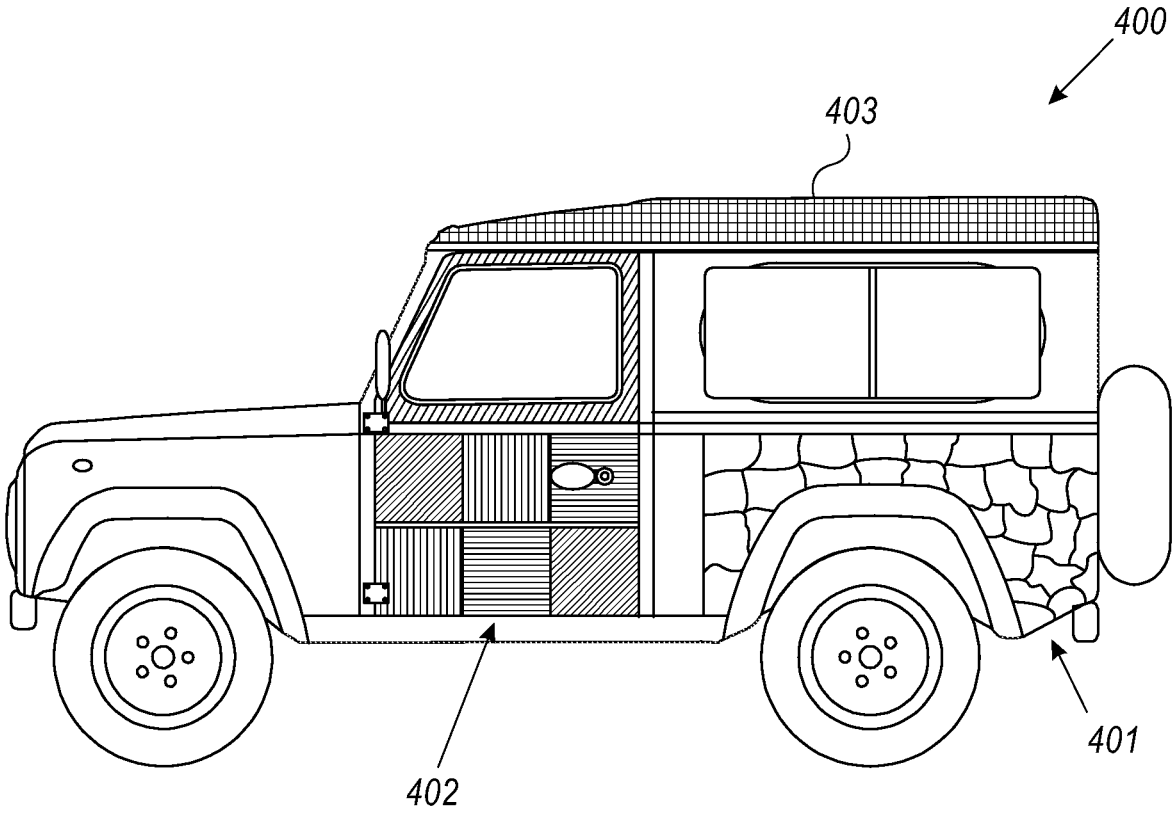
FIG. 5 is an illustration of a vehicle having three different distinct regions implementation both the skin and segmented configurations according to some embodiments of the present disclosure.

In the illustration provided in FIG. 5, a camouflaged vehicle 400 is shown provided with three continuous yet distinct surface regions 401, 402 and 403 that are each covered with a different set of material components, and/or in a different layering sequence, thereby each exhibiting a different camouflage profile. In this particular example, surface region 401 is covered with a plurality of differently shaped and sized segments, surface region 402 is covered with a plurality of square-shaped and identically sized segments, and region 403 is provided as a skin coat according to some embodiments of the present disclosure.

It will be appreciated that the embodiments described above are cited by way of example, and that the present disclosure is not limited to what has been particularly shown and described hereinabove. Rather, the scope of the present disclosure includes both combinations and subcombinations of the various features described hereinabove, as well as variations and modifications thereof which would occur to persons skilled in the art upon reading the foregoing description and which are not disclosed in the prior art.

The invention claimed is:

1. An apparatus comprising a coating adhered to a surface of an object, the coating comprising:

at least one first stacked material arrangement comprising a first substrate, a first external layer, and a first plurality of material layers disposed between the first substrate and the first external layer, that provides a first multispectral camouflage profile; and at least one second stacked material arrangement, laterally adjacent to the first stacked material arrangement, the second stacked material arrangement comprising a second substrate, a second external layer, and a second plurality of material layers, different than the first plurality of material layers and disposed between the second substrate and the second external layer, the second stacked material arrangement providing a second multispectral camouflage profile different than the first multispectral camouflage profile, wherein the first plurality of material layers comprises: a water-repellent layer, an anti-corrosion layer, a visual/IR emissivity layer, IR blocking layer, a hardening layer, an insulating layer, or an interface layer.

2. The coating according to claim 1, wherein the first stacked material arrangement is provided as a first segment of the coating, the first segment having the first multispectral camouflage profile.

3. The coating according to claim 1, wherein the first plurality of material layers includes more than one IR emissivity layer or more than one IR blocking layer.

4. The coating according to claim 1, further comprising:

at least one third stacked material arrangement, laterally adjacent to at least one of the first stacked material arrangement or the second stacked material arrangement, the third stacked material arrangement comprising a third substrate, a third external layer, and a third plurality of material layers, different than the first plurality of material layers and the second plurality of material layers and disposed between the third substrate and the third external layer, the third stacked material arrangement providing a third multispectral camouflage profile different than the first multispectral camouflage profile and the second multispectral camouflage profile; and at least one fourth stacked material arrangement, laterally adjacent to at least one of the first stacked material arrangement, the second stacked material arrangement, or the third stacked material arrangement, wherein the fourth stacked material arrangement comprises a fourth substrate, a fourth external layer, and a fourth plurality of material layers, different than the first plurality of material layers, the second plurality of material layers, and the third plurality of material layer, wherein the fourth plurality of material layers is disposed between the fourth substrate and the fourth external layer, the fourth stacked material arrangement providing a fourth multispectral camouflage profile different than the first multispectral camouflage profile, the second multispectral camouflage profile, and the third multispectral camouflage profile.

5. The coating according to claim 1, wherein the first plurality of material layers includes an insulating layer configured to prevent heat generated by the object from flowing towards an external surface of the coating.

6. A multispectral coating adhered to a surface of an object, the multispectral coating comprising:

at least one first stacked material arrangement comprising a first substrate, a first external layer, and a first plurality of material layers disposed between the first substrate and the first external layer, that provides a first multispectral camouflage profile; and at least one second stacked material arrangement laterally adjacent to the first stacked material arrangement, the second stacked material arrangement comprising a second substrate, a second external layer, and a second plurality of material layers, different than the first plurality of material layers and disposed between the second substrate and the second external layer, the second stacked material arrangement providing a second multispectral camouflage profile different than the first multispectral camouflage profile, wherein the first plurality of material layers comprises: a water-repellent layer, an anti-corrosion layer, a visual/IR emissivity layer, IR blocking layer, a hardening layer, an insulating layer, or an interface layer.

7. The multispectral coating according to claim 6, wherein the first plurality of material layers comprises more than one IR emissivity layer or more than one IR blocking layer.

8. The multispectral coating according to claim 6, further comprising:

at least one third stacked material arrangement, laterally adjacent to at least one of the first stacked material arrangement or the second stacked material arrangement, the third stacked material arrangement comprising a third substrate, a third external layer, and a third plurality of material layers, different than the first plurality of material layers and the second plurality of material layers and disposed between the third substrate and the third external layer, the third stacked material arrangement providing a third multispectral camouflage profile different than the first multispectral camouflage profile and the second multispectral camouflage profile.

9. The multispectral coating according to claim 6, wherein the first plurality of material layers comprises an insulating layer configured to prevent heat generated by the object from flowing towards an external surface of the multispectral coating.

10. The multispectral coating according to claim 6, wherein the object is a stationary object or a mobile object.

11. The multispectral coating according to claim 10, wherein the object is one of a platform, a land vehicle, an aerial vehicle, a drone, a maritime vehicle, and a vessel.

12. The multispectral coating according to claim 6, wherein the first stacked material arrangement and the second stacked material arrangement are formed directly onto the surface of the object.

13. The multispectral coating according to claim 6, wherein the first stacked material arrangement and the second stacked material arrangement are configured to attach to the surface of the object.

14. The multispectral coating according to claim 13, wherein the first stacked material arrangement and the second stacked material arrangement are configured to attach to the surface of the object by touch fasteners, magnets, or an adhesive.

15. The multispectral coating according to claim 6, wherein the first stacked material arrangement is configured to coat discrete or preselected surface regions of the object.

16. The multispectral coating according to claim 6, wherein the first stacked material arrangement and the second stacked material arrangement each comprises a water-repellent layer, an anti-corrosion layer, a visual/IR emissivity layer, IR blocking layer, a hardening layer, an insulating layer, and an interface layer.

17. The multispectral coating according to claim 6, wherein the first substrate is configured to attach to a surface region on the object.

18. The multispectral coating according to claim 17, wherein the first substrate is a base sheet made of a metallic material, a polymeric material, a ceramic material, or a rigid fabric.

19. A coating adhered to a surface of an object, the coating comprising:

at least one first stacked material arrangement comprising a first substrate, a first external layer, and a first plurality of material layers disposed between the first substrate and the first external layer, that provides a first multispectral camouflage profile; and at least one second stacked material arrangement, laterally adjacent to the first stacked material arrangement, the second stacked material arrangement comprising a second substrate, a second external layer, and a second plurality of material layers, different than the first plurality of material layers and disposed between the second substrate and the second external layer, the second stacked material arrangement providing a second multispectral camouflage profile different than the first multispectral camouflage profile, wherein the first plurality of material layers comprises: a water repellent layer, an anti-corrosion layer, a visual/IR emissivity layer, IR blocking layer, a hardening layer, an insulating layer or an interface layer.

* * * * *